US012276015B2

(12) United States Patent
Kubushiro

(10) Patent No.: US 12,276,015 B2
(45) Date of Patent: Apr. 15, 2025

(54) METHOD OF MANUFACTURING TiAl ALLOY AND TiAl ALLOY

(71) Applicant: IHI Corporation, Tokyo (JP)

(72) Inventor: Keiji Kubushiro, Tokyo (JP)

(73) Assignee: IHI Corporation, Tokyo (JP)

( * ) Notice: Subject to any disclaimer, the term of this patent is extended or adjusted under 35 U.S.C. 154(b) by 662 days.

(21) Appl. No.: 17/450,724

(22) Filed: Oct. 13, 2021

(65) Prior Publication Data

US 2022/0205075 A1 Jun. 30, 2022

Related U.S. Application Data

(63) Continuation of application No. PCT/JP2020/012032, filed on Mar. 18, 2020.

(30) Foreign Application Priority Data

May 23, 2019 (JP) ..... 2019-096653

(51) Int. Cl.
*C22F 1/18* (2006.01)
*C22C 1/02* (2006.01)
*C22C 14/00* (2006.01)

(52) U.S. Cl.
CPC ..... *C22F 1/183* (2013.01); *C22C 1/02* (2013.01); *C22C 14/00* (2013.01)

(58) Field of Classification Search
CPC ..... C22C 1/02; C22C 14/00; C22F 1/183
See application file for complete search history.

(56) References Cited

U.S. PATENT DOCUMENTS 5,226,985 A * 7/1993 Kim ..... C22F 1/183 148/669
5,514,333 A 5/1996 Fujiwara et al.
(Continued)

FOREIGN PATENT DOCUMENTS

JP 07-076745 A 3/1995
JP 10-156473 A 6/1998
(Continued)

OTHER PUBLICATIONS

International Search Report issued Jun. 16, 2020 in PCT/JP2020/012032 filed on Mar. 18, 2020, 2 pages.

*Primary Examiner* — Nicholas A Wang
(74) *Attorney, Agent, or Firm* — Oblon, McClelland, Maier & Neustadt, L.L.P.

(57) ABSTRACT

A method of manufacturing a TiAl alloy includes a casting step of melting and casting a TiAl alloy raw material which contains 42 at % or more and 45 at % or less of Al, 3 at % or more and 6 at % or less of Nb, 3 at % or more and 6 at % or less of V, 0.1 at % or more and 0.3 at % or less of B, and the balance being Ti and inevitable impurities, a hot forging step of hot forging the cast TiAl alloy by heating the cast TiAl alloy to a temperature range between 1200° C. or higher and 1350° C. or lower, and a thermal treatment step of holding the hot-forged TiAl alloy at a temperature range between 1220° C. or higher and 1300° C. or lower for a hour range between 1 hour or longer and 5 hours or shorter, applying a first thermal treatment to the hot-forged TiAl alloy, cooling the TiAl alloy subjected to the first thermal treatment to a temperature range between 1000° C. or higher and 1100° C. or lower at a cooling rate of 400° C./hour or more, holding the TiAl alloy subjected to the first thermal treatment at a temperature range between 100 ° C. or higher and 1100° C. or lower for a hour range between 1 hour or longer and 4 hours or shorter, applying a second thermal
(Continued)

treatment to the TiAl alloy subjected to the first thermal treatment, and rapidly cooling the TiAl alloy subjected to the second thermal treatment.

3 Claims, 10 Drawing Sheets

(56) References Cited

U.S. PATENT DOCUMENTS

| | | | | |
|---|---|---|---|---|
| 2016/0265096 | A1* | 9/2016 | Janschek | C22F 1/002 |
| 2019/0106778 | A1* | 4/2019 | Kubushiro | C22F 1/02 |

FOREIGN PATENT DOCUMENTS

| | | | |
|---|---|---|---|
| JP | WO2018043187 | * | 3/2018 |
| WO | WO 2018/043187 A1 | | 3/2018 |

* cited by examiner

METHOD OF MANUFACTURING TiAl ALLOY AND TiAl ALLOY

CROSS REFERENCE TO RELATED APPLICATIONS

This application is a continuation application of International Application No.PCT/JP2020/012032, filed on Mar. 18, 2020, which claims priority to Japanese Patent Application No. 2019-096653, filed on May 23,2019, the entire contents of which are incorporated by references herein.

BACKGROUND

1. Field

The present disclosure relates to a method of manufacturing a TiAl alloy and a TiAl alloy.

2. Description of the related art

A TiAl (titanium aluminide) alloy is an alloy formed of an intermetallic compound of Ti (titanium) and Al (aluminium). The TiAl alloy is excellent in the heat resistance, and has a lighter weight and larger specific strength than an Ni-base alloy, and thus, the TiAl alloy is applied to aircraft engine components such as turbine blades. Aircraft engine components and the like are formed by hot forging the TiAl alloy. See Japanese Patent Application Publication No. Hei 10-156473 (Patent Literature 1).

SUMMARY

In order to reduce the weight of TiAl alloy parts such as turbine blades, to increase the specific strength of the TiAl alloy by increasing the strength thereof is needed. For this reason, the TiAl alloy is typically thermal-treated after being subjected to hot forging. The thermal treatment is performed by holding the hot-forged TiAl alloy at a recrystallization temperature and then rapidly cooling the hot-forged TiAl alloy from the recrystallization temperature to a room temperature. However, when such thermal treatment is performed to the hot-forged TiAl alloy, although the mechanical strength of the TiAl alloy improves, the ductility may be degraded.

Therefore, an object of the present disclosure is to provide a method of manufacturing a TiAl alloy and a TiAl alloy capable of improving the mechanical strength and the ductility of a TiAl alloy in a good balance.

A method of manufacturing a TiAl alloy according to the present disclosure includes a casting step of melting and casting a TiAl alloy raw material which contains 42 at % or more and 45 at % or less of Al, 3 at % or more and 6 at % or less of Nb, 3 at % or more and 6 at % or less of V, 0.1 at % or more and 0.3 at % or less of B, and the balance being Ti and inevitable impurities, a hot forging step of hot forging the cast TiAl alloy by heating the cast TiAl alloy to a temperature range between 1200° C. or higher and 1350° C. or lower, and a thermal treatment step of holding the hot-forged TiAl alloy at a temperature range between 1220° C. or higher and 1300° C. or lower for a hour range between 1 hour or longer and 5 hours or shorter, applying a first thermal treatment to the hot-forged TiAl alloy, cooling the TiAl alloy subjected to the first thermal treatment to a temperature range between 1000° C. or higher and 1100° C. or lower at a cooling rate of 400° C./hour or more, holding the TiAl alloy subjected to the first thermal treatment at a temperature range between 1000° C. or higher and 1100° C. or lower for a hour range between 1 hour or longer and 4 hours or shorter, applying a second thermal treatment to the TiAl alloy subjected to the first thermal treatment, and rapidly cooling the TiAl alloy subjected to the second thermal treatment.

In the method of manufacturing the TiAl alloy according to the present disclosure, a cooling rate when the TiAl alloy subjected to the first thermal treatment is cooled may be 600° C./hour or more in the thermal treatment step.

The method of manufacturing the TiAl alloy according to the present disclosure may include a stress relieving step of relieving stress by holding the TiAl alloy which is thermal-treated in the thermal treatment step at a temperature range between 850° C. or higher and 950° C. or lower for a hour range between 0.5 hour or longer and 4 hours or shorter.

A TiAl alloy according to the present disclosure contains 42 at % or more and 45 at % or less of Al, 3 at % or more and 6 at % or less of Nb, 3 at % or more and 6 at % or less of V, 0.1 at % or more and 0.3 at % or less of B, and the balance being Ti and inevitable impurities, and wherein the room temperature ultimate tensile strength is 800 MPa or more, and the room temperature tensile fracture strain is 1.8% or more.

According to the thus-configured method of manufacturing a TiAl alloy and the thus-configured TiAl alloy, it is possible to improve the mechanical strength and the ductility of the TiAl alloy in a good balance.

DESCRIPTION OF EMBODIMENTS

Figure 1:
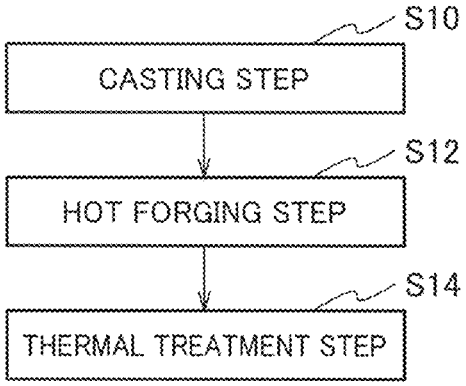
FIG. 1 is a flow chart showing a configuration of a method of manufacturing a TiAl alloy in an embodiment of the present disclosure.

An embodiment of the present disclosure will be described in detail below with reference to the drawings. FIG. 1 is a flow chart showing a configuration of a method of manufacturing a TiAl alloy. The method of manufacturing the TiAl alloy includes a casting step (S10), a hot forging step (S12), and a thermal treatment step (S14).

First, the TiAl alloy will be described. The TiAl alloy is an alloy formed of an intermetallic compound of Ti (titanium) and Al (aluminium). The TiAl alloy contains 42 at % or more and 45 at % or less of Al, 3 at % or more and 6 at % or less of Nb, 3 at % or more and 6 at % or less of V, 0.1 at % or more and 0.3 at % or less of B, and the balance being Ti and inevitable impurities. Next, the reason why a composition range of each alloy component contained in the TiAl alloy is limited will be explained.

The content of Al (aluminium) is in a range between 42 at % or more and 45 at % or less. If the content of Al is less than 42 at %, the content of Ti becomes relatively large, and accordingly, the specific gravity becomes large and the specific strength decreases. If the content of Al is more than 45 at %, a hot forging temperature becomes high, and thus the hot forgeability degrades.

Nb (niobium) is a β-phase stabilizing element and has a function of forming a β-phase that is excellent in high-temperature deformation during hot forging. The content of Nb is in a range between 3 at % or more and 6 at % or less. If the content of Nb is in a range between 3 at % or more and 6 at % or less, the β-phase can be formed during hot forging. Further, if the content of Nb is less than 3 at %, or if the content of Nb is more than 6 at %, the mechanical strength decreases.

V (vanadium) is the β-phase stabilizing element and has a function of forming the β-phase that is excellent in high-temperature deformation during hot forging. The content of V is in a range between 3 at % or more and 6 at % or less. If the content of V is in a range between 3 at % or more and 6 at % or less, the β-phase can be formed during hot forging. Further, if the content of V is less than 3 at %, the hot forgeability degrades. If the content of V is more than 6 at %, the mechanical strength decreases.

B (boron) has a function of enhancing the ductility by refining crystal grains. The addition of B enhances the ductility in a temperature range between 1100° C. or higher and 1350° C. or lower, and enhances the ductility more in a temperature range between 1200° C. or higher and 1350° C. or lower. As described above, B has a function of enhancing the ductility at high temperatures, and thus, the hot forgeability can be improved.

The content of B is in a range between 0.1 at % or more and 0.3 at % or less. If the content of B is less than 0.1 at %, a grain size of the crystal grains becomes larger than 200 pm, and the ductility is degraded, and accordingly the hot forgeability is degraded. If the content of B is more than 0.3 at %, the ductility degrades because borides with a grain size larger than 100 μm are easily formed at the time of forming an ingot, and accordingly the hot forgeability is degraded. The boride is formed in a needle shape and is formed of TiB, $TiB_2$ and the like.

The casting step (S10) is a step of melting and casting a TiAl alloy raw material which contains 42 at % or more and 45 at % or less of Al, 3 at % or more and 6 at % or less of Nb, 3 at % or more and 6 at % or less of V, 0.1 at % or more and 0.3 at % or less of B, and the balance being Ti and inevitable impurities. The TiAl alloy raw material is melted in a vacuum induction furnace or the like and cast to form an ingot or the like. Casting of the TiAl alloy raw material can be performed by using a casting system which is used for casting a general metallic material.

The cast TiAl alloy does not pass through an α single phase region during a process of cooling the cast TiAl alloy at a melting temperature. If the cast TiAl alloy passes through the α single phase region, crystal grains are coarsened, and accordingly the ductility degrades. The cast TiAl alloy does not pass through the α single phase region, and accordingly, coarsening of the crystal grains is suppressed.

In a metal structure of the cast TiAl alloy, a crystal grain size is 200 μm or less, and borides with a grain size of 100 μm or less are contained. The borides are formed in a needle shape or the like, and are formed of TiB, TiB2 and the like. As described above, the metal structure of the cast TiAl alloy is formed of the fine crystal grains with a crystal grain size of 200 μm or less, and contains the borides with a small grain size of 100 μm or less, and accordingly, the hot forgeability can be improved.

The hot forging step (S14) is a process of hot forging the cast TiAl alloy by heating the cast TiAl alloy to a temperature range between 1200° C. or higher and 1350° C. or lower. The cast TiAl alloy is heated to a temperature range between 1200° C. or higher and 1350° C. or lower so as to be held in a two-phase region of an α-phase+the β-phase or a three-phase region of the α-phase+the β-phase+a γ-phase. The heated cast TiAl alloy contains the β-phase which is excellent in high-temperature deformation, and thus, the cast TiAl alloy is easily deformed. Further, the cast TiAl alloy does not pass through the α single phase region while a temperature of the cast TiAl alloy is raised from a room temperature to a heating temperature range between 1200° C. or higher and 1350° C. or lower. Since the cast TiAl alloy does not pass through the α single phase region, the degradation in the ductility is suppressed by suppressing the coarsening of the crystal grains, and accordingly, the hot forgeability can be improved.

The cast TiAl alloy may be forged at a strain rate faster than 1/second, while the cast TiAl alloy is in a state of being heated to a temperature range between 1200° C. or higher and 1350° C. or lower. Even if the cast TiAl alloy is forged at a strain rate faster than 1/second, since the peak stress is small, the deformation resistance becomes small, and accordingly, hot forging cracks can be suppressed. The strain rate at the time of applying hot forging can be, for example, faster than 1/second and 10/second or slower, or can be 10/second or faster. The hot forging may be applied in an inert gas atmosphere with gas such as argon gas in order to prevent the oxidation. As a hot forging method for the TiAl alloy, a hot forging method for a general metallic material such as free-forging, die forging, roll forging, extrusion, or a hot forging apparatus can be used. After applying hot forging, the hot-forged TiAl alloy is slowly cooled by furnace cooling or the like. The hot-forged TiAl alloy does not pass through the α single phase region, even if the hot-forged TiAl alloy is in a slowly cooled state, and thus, coarsening of the crystal grains is suppressed.

In the thermal treatment step (S14), the hot-forged TiAl alloy is subjected to a first thermal treatment by being held at a temperature range between 1220° C. or higher and 1300° C. or lower for a hour range between 1 hour or longer and 5 hours or shorter, then the TiAl alloy subjected to the first thermal treatment is cooled to a temperature range between 1000° C. or higher and 1100° C. or lower at a cooling rate of 400° C./hour or more, then the TiAl alloy subjected to the first thermal treatment is subjected to a second thermal treatment by being held at a temperature range between 1000° C. or higher and 1100° C. or lower for a hour range between 1 hour or longer and 4 hours or shorter, and then, the TiAl alloy subjected to the second thermal treatment is rapidly cooled.

First, the hot-forged TiAl alloy is heated to a temperature range between 1220° C. or higher and 1300° C. or lower, and then held at a temperature range between 1220° C. or higher and 1300° C. or lower for a hour range between 1 hour or longer and 5 hours or shorter to be subjected to the first thermal treatment. The hot-forged TiAl alloy has been strained when being applied with hot forging processing, and thus, the hot-forged TiAl alloy is recrystallized by being subjected to the first thermal treatment. The TiAl alloy can be recrystallized by heating and holding the TiAl alloy at a temperature range between 1220° C. or higher and 1300° C. or lower. The hot-forged TiAl alloy is held in the two-phase region of the α-phase+the β-phase or the three-phase region of the α-phase+the β-phase+the γ-phase by being heated to a temperature range between 1220° C. or higher and 1300° C. or lower.

A time length during which the TiAl alloy is held at a temperature range between 1220° C. or higher and 1300° C. or lower is in a hour range between 1 hour or longer and 5 hours or shorter. If a holding time is shorter than 1 hour, the recrystallization is not performed satisfactorily, and there is a possibility that the unrecrystallization is remained. The reason why the holding time is set to be 5 hours or shorter is because, if the holding time is 5 hours, the recrystallization is performed satisfactorily, and remaining of the unrecrystallization can be suppressed. By setting the holding time in a hour range between 1 hour or longer and 5 hours or shorter, metal structures of the TiAl alloys become substantially the same, and the mechanical strength and the like can be substantially constant. Further, the holding time may be in a hour range between 2.5 hours or longer and 3.5 hours or shorter.

After being subjected to the first thermal treatment, the TiAl alloy subjected to the first thermal treatment is cooled at a cooling rate of 400° C./hour or more, to a temperature range between 1000° C. or higher and 1100° C. or lower, from a temperature range between 1220° C. or higher and 1300° C. or lower. Cooling of the TiAl alloy subjected to the first thermal treatment may be performed by furnace cooling. The reason why the cooling rate of the TiAl alloy which is cooled after being subjected to the first thermal treatment is 400° C./hour or more is because, in the case of the TiAl alloy, lamellar grains precipitate if the cooling rate is less than 400° C./hour. By setting the cooling rate of the TiAl alloy which is cooled after being subjected to the first thermal treatment to 400° C./hour or more, it is possible to suppress the precipitation of lamellar grains in a high temperature range, from a temperature range between 1220° C. or higher and 1300° C. or lower, to a temperature range between 1000° C. or higher and 1100° C. or lower.

More particularly, the lamellar grains precipitate from the α-phase. The lamellar grains are formed from $\alpha_2$ phases and γ-phases which are regularly arranged one another in a layered structure. The $\alpha_2$ phases are formed of $Ti_3Al$, and the γ-phases are formed of TiAl. When the lamellar grains are precipitated in a high temperature range from a temperature range between 1220° C. or higher and 1300° C. or lower to a temperature range between 1000° C. or higher and 1100° C. or lower, the lamellar grains are thermal-treated at a high temperature. When the lamellar grains are thermal-treated at a high temperature, the lamellar layer spacing between the $\alpha_2$ phases and the γ-phases which form the lamellar grains becomes wide, and accordingly, the mechanical strength of the TiAl alloy is easily degraded. If the cooling rate after performing the first thermal treatment is 400° C./hour or more, it is possible to suppress the precipitation of the lamellar grains in the high temperature range in the TiAl alloy.

The cooling rate after performing the first thermal treatment may be 600° C./hour or more. The precipitation of the lamellar grains in the high temperature range in the TiAl alloy can be further suppressed by setting the cooling rate after performing the first thermal treatment to 600° C./hour or more. This can further enhance the mechanical strength of the TiAl alloy. The cooling rate after performing the first thermal treatment may be in a range between 400° C./hour or more and 1000° C./hour or less, and may be in a range between 600° C./hour or more and 1000° C./hour or less. The reason why the above ranges of the cooling rates are favorable is because, if the cooling rate after performing the first thermal treatment to the alloy is 1000° C./hour, the precipitation of the lamellar grains in the high temperature range can be favorably suppressed.

Next, after being subjected to the first thermal treatment, the TiAl alloy subjected to the first thermal treatment is cooled at a cooling rate of 400° C./hour or more to a temperature range between 1000° C. or higher and 1100° C. or lower, and then held at a temperature range between 1000° C. or higher and 1100° C. or lower for a hour range between 1 hour or longer and 4 hours or shorter so as to be subjected to the second thermal treatment. By performing the second thermal treatment to the TiAl alloy subjected to the first thermal treatment, the TiAl alloy subjected to the first thermal treatment is aged while the precipitation of the lamellar grains is suppressed so that fine γ grains are precipitated.

More specifically, fine γ grains can be precipitated from the β-phase or the γ-phase by performing the second thermal treatment to the TiAl alloy at a temperature range between 1000° C. or higher and 1100° C. or lower and aging the TiAl alloy. The fine γ grains are formed of TiAl and have a function of enhancing the ductility and the high-temperature strength of the TiAl alloy. Further it is possible to suppress the precipitation of the lamellar grains in an intermediate temperature range between 1000° C. or higher and 1100° C. or lower in the TiAl alloy. Even if a small amount of lamellar grains are precipitated, since the alloy is heated in the intermediate temperature range instead of being heated in the above high temperature range, the widening of the lamellar layer spacing can be suppressed. A thermal treatment temperature of the second thermal treatment may be in a temperature range between 1000° C. or higher and 1050° C. or lower, or 1000° C. This can further suppress the precipitation of the lamellar grains.

The holding time at a temperature range between 1000° C. or higher and 1100° C. or lower is in a hour range between 1 hour or longer and 4 hours or shorter. If the holding time is shorter than 1 hour, it is difficult to precipitate the fine γ grains favorably. If the holding time is 4 hours, the fine γ grains can be precipitated favorably. Further, if the holding time is longer than 4 hours, a large number of fine γ grains are precipitated and the mechanical strength may be degraded. If the holding time is set to be in a hour range between 1 hour or longer and 4 hours or shorter, the metal structures of the TiAl alloys become substantially the same, and the mechanical strength and the like can be substantially constant. Further, the holding time may be in hour range between 2 hours or longer and 4 hours or shorter.

Next, after being subjected to the second thermal treatment, the TiAl alloy subjected to the second thermal treatment is cooled by rapid cooling. The TiAl alloy subjected to the second thermal treatment is rapidly cooled from a temperature range between 1000° C. or higher and 1100° C. or lower to a room temperature so as to precipitate the lamellar grains. The lamellar grains precipitated by rapidly cooling the TiAl alloy subjected to the second thermal treatment from a temperature range between 1000° C. or higher and 1100° C. or lower has narrow lamellar layer spacing and are formed with fine lamellar grains. The fine lamellar grains are formed to have small lamellar layer spacing, and thus, the mechanical strength of the TiAl alloy can be enhanced. Further, since the TiAl alloy subjected to the second thermal treatment is rapidly cooled from a temperature range between 1000° C. or higher and 1100° C. or lower, the heating of the precipitated lamellar grains is suppressed, and the widening of the lamellar layer spacing is suppressed. In a cooling method, the TiAl alloy subjected to the second thermal treatment may be rapidly cooled from a temperature range between 1000° C. or higher and 1100° C. or lower to a room temperature by gas fan cooling or the like. The TiAl alloy subjected to the second thermal treatment may be rapidly cooled at a cooling rate that is equal to or higher than that of air cooling. Since the thermal-treated TiAl alloy does not pass through the α single phase region when the TiAl alloy is subjected to the thermal treatment, the coarsening of the crystal grains is suppressed, and accordingly, the degradation in the ductility is suppressed.

The method of manufacturing the TiAl alloy may include a stress relieving step of relieving stress by holding the TiAl alloy which is thermal-treated in the thermal treatment step (S14) at a temperature range between 800° C. or higher and 950° C. or lower for a hour range between 1 hour or longer and 5 hours or shorter. Residual stress and the like can be relieved by heating the thermal-treated TiAl alloy to a temperature range between 800° C. or higher and 950° C. or lower and holding the TiAl alloy at a temperature range between 800° C. or higher and 950° C. or lower for a hour range between 1 hour or longer and 5 hours or shorter to relieve stress.

Further, by holding the thermal-treated TiAl alloy at a temperature range between 800° C. or higher and 950° C. or lower for a hour range between 1 hour or longer and 5 hours or shorter, it is possible to stabilize a lamellar structure of the fine lamellar grains in addition to stress relief. The ductility of the TiAl alloy can be further improved by reducing a volume fraction of the $\alpha_2$ phase forming the lamellar structure.

The thermal treatment and the stress relief may be performed in a vacuum atmosphere or an inert gas atmosphere with gas such as argon gas in order to prevent the oxidation. For the thermal treatment and the stress relief, an atmosphere furnace or the like used for applying thermal treatment to general metallic materials can be used.

Next, a metal structure of the TiAl alloy after being subjected to the thermal treatment will be described. The metal structure of the TiAl alloy is formed of fine crystal grains with a crystal grain size of 200 μm or less. This can improve the ductility of the TiAl alloy. Further, the metal structure of the TiAl alloy contains fine lamellar grains and fine γ grains. The fine γ grains contain a boride with a grain size of 0.1 μm or less. The boride is formed of TiB, $TiB_2$ or the like in a needle shape or the like. The fine lamellar grains have small and narrow lamellar layer spacing, and thus, the mechanical strength such as the tensile strength, the fatigue strength, and the creep strength can be improved. The fine γ grains can improve the ductility and the high-temperature strength. The fine borides with a grain size of 0.1 μm or less can improve the mechanical strength.

Next, mechanical characteristics of the TiAl alloy after being subjected to the thermal treatment will be described. The mechanical characteristics of the TiAl alloy after being subjected to the thermal treatment at room temperature may be such that room temperature ultimate tensile strength is 800 MPa or more and room temperature tensile fracture strain is 1.8% or more, when tensile tests are performed in accordance with JIS, ASTM and the like. Further, high temperature creep characteristics of the TiAl alloy after being subjected to the thermal treatment can be high temperature creep characteristics equivalent to those when the TiAl alloy is rapidly cooled from a recrystallization temperature to a room temperature.

Figure 2:
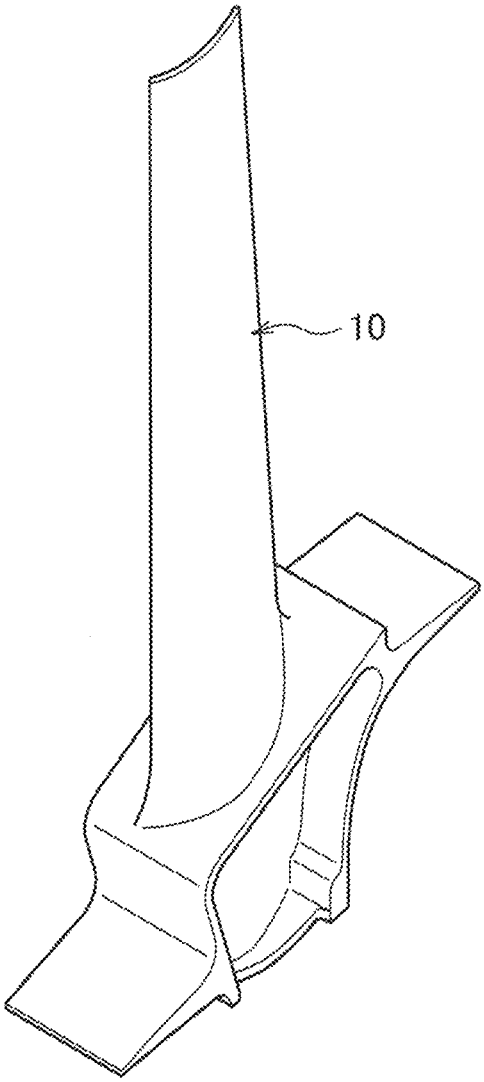
FIG. 2 is a diagram showing a constitution of a turbine blade in an embodiment of the present disclosure.

The TiAl alloy according to the embodiment of the present disclosure can be applied to a turbine blade or the like of an aircraft engine component. FIG. 2 is a diagram showing a constitution of a turbine blade 10. The TiAl alloy has high mechanical strength such as high-temperature strength, and thus, the heat resistance of the turbine blade 10 can be improved. Further, the TiAl alloy is excellent in the ductility such as the room temperature ductility, and thus, even when the turbine blade 10 is assembled or fitted, damage to the turbine blade 10 can be suppressed.

The above described method of manufacturing the TiAl alloy includes a casting step of melting and casting the TiAl alloy raw material which contains 42 at % or more and 45 at % or less of Al, 3 at % or more and 6 at % or less of Nb, 3 at % or more and 6 at % or less of V, 0.1 at % or more and 0.3 at % or less of B, and the balance being Ti and inevitable impurities, a hot forging step of hot forging the cast TiAl alloy by heating the cast TiAl alloy to a temperature range between 1200° C. or higher and 1350° C. or lower, and a thermal treatment step in which the hot-forged TiAl alloy is held at a temperature range between 1220° C. or higher and 1300° C. or lower for a hour range between 1 hour or longer and 5 hours or shorter to be subjected to the first thermal treatment, the TiAl alloy subjected to the first thermal treatment is cooled to a temperature range between 1000° C. or higher and 1100° C. or lower at a cooling rate of 400° C./hour or more and is held at a temperature range between 1000° C. or higher and 1100° C. or lower for a hour range between 1 hour or longer and 4 hours or shorter to be subjected to the second thermal treatment, followed by rapidly cooling. This enables manufacturing of the TiAl alloy with the mechanical strength and the ductility which are improved in a good balance.

The above described TiAl alloy contains 42 at % or more and 45 at % or less of Al, 3 at % or more and 6 at % or less of Nb, 3 at % or more and 6 at % or less of V, 0.1 at % or more and 0.3 at % or less of B, and the balance being Ti and inevitable impurities, and has room temperature ultimate tensile strength of 800 MPa or more and room temperature tensile fracture strain of 1.8% or more. This enables the improvement of the mechanical strength and the ductility of the TiAl alloy in a good balance.

EXAMPLES (Casting of TiAl Alloy)

An ingot of the TiAl alloy was formed by melting the TiAl alloy raw material in a high-frequency vacuum melting furnace and casting the TiAl alloy raw material. The TiAl alloy contains 43 at % of Al, 4 at % of Nb, 5 at % of V, 0.2 at % of B, and the balance being Ti and inevitable impurities.

(Hot Forging)

Hot forging was applied to the cast TiAl alloy. In the hot forging, the cast TiAl alloy was heated to 1200° C. to be held in a two-phase region of an α-phase+β-phase, and press forging was applied to the cast TiAl alloy at a strain rate of 10/second. After being subjected to the press forging, the hot-forged TiAl alloy was cooled to a room temperature by furnace cooling.

(Thermal Treatment)

Figure 3:
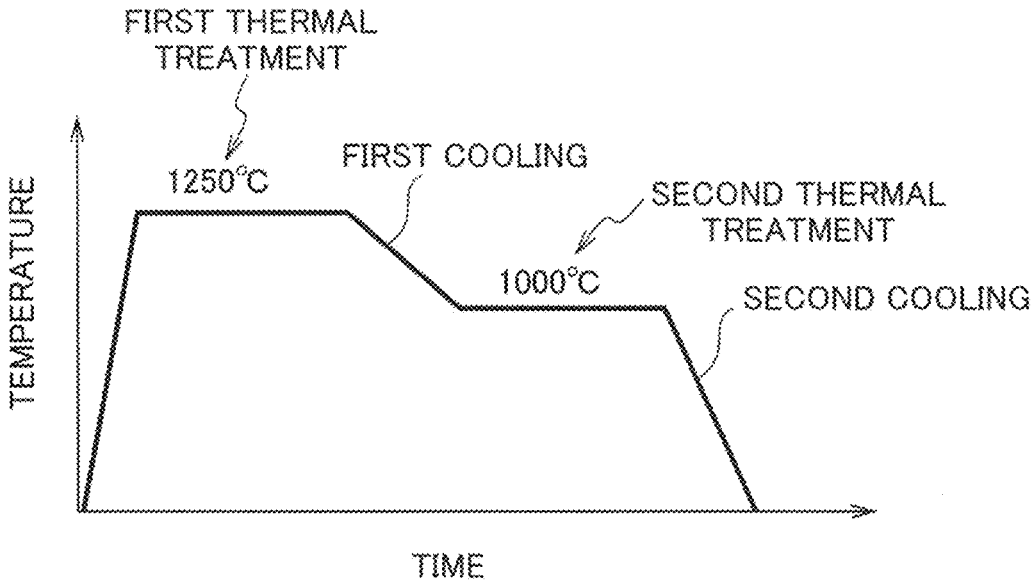
FIG. 3 is a schematic diagram showing a configuration of a thermal treatment in an embodiment of the present disclosure.

Thermal treatment was performed to the hot-forged TiAl alloy. The TiAl alloys of Reference Examples 1 to 3, Examples 1 to 7, and Comparative Example 1 were prepared by changing thermal treatment conditions. The TiAl alloys of Reference Examples 1 to 3, Examples 1 to 7, and Comparative Example 1 differed in the thermal treatment conditions, but were same in an alloy composition and a hot forging condition. First, the TiAl alloys of Reference Examples 1 to 3 and Examples 1 to 7 will be described. FIG. 3 is a schematic diagram showing a configuration of the thermal treatment. Table 1 shows the thermal treatment conditions.

TABLE 1

| | THERMAL TREATMENT CONDITION | | | | | |
|---|---|---|---|---|---|---|
| | FIRST THERMAL TREATMENT TEMPERATURE (° C.) | FIRST THERMAL TREATMENT TIME (HOUR) | FIRST COOLING RATE (° C./HOUR) | SECOND THERMAL TREATMENT TEMPERATURE (° C.) | SECOND THERMAL TREATMENT TIME (HOUR) | SECOND COOLING RATE |
| REFERENCE EXAMPLE 1 | 1250 | 3 | 100 | 1000 | 3 | RAPID COOLING |
| REFERENCE EXAMPLE 2 | 1250 | 3 | 200 | 1000 | 3 | RAPID COOLING |
| EXAMPLE 1 | 1250 | 3 | 400 | 1000 | 3 | RAPID COOLING |
| EXAMPLE 2 | 1250 | 3 | 600 | 1000 | 3 | RAPID COOLING |
| EXAMPLE 3 | 1250 | 3 | 1000 | 1000 | 3 | RAPID COOLING |
| EXAMPLE 4 | 1250 | 2.5 | 400 | 1000 | 3 | RAPID COOLING |
| EXAMPLE 5 | 1250 | 3.5 | 400 | 1000 | 3 | RAPID COOLING |
| EXAMPLE 6 | 1250 | 3 | 400 | 1000 | 2 | RAPID COOLING |
| EXAMPLE 7 | 1250 | 3 | 400 | 1000 | 4 | RAPID COOLING |
| REFERENCE EXAMPLE 3 | 1250 | 3 | 400 | 1000 | 0 | RAPID COOLING |

As shown in FIG. 3, in the thermal treatment, the hot-forged TiAl alloy was subjected to the first thermal treatment, then, the TiAl alloy subjected to the first thermal treatment was cooled by first cooling, then, the TiAl alloy subjected to the first cooling was subjected to the second thermal treatment, then, the TiAl alloy subjected to the second thermal treatment was cooled to a room temperature by second cooling. In the first cooling, the TiAl alloy subjected to the first thermal treatment was cooled by furnace cooling, and in the second cooling, the TiAl alloy subjected to the second thermal treatment was rapid cooled by gas fan cooling. The thermal treatment was performed in a vacuum atmosphere. Table 1 shows a first thermal treatment temperature, a first thermal treatment time that is a time during which the TiAl alloy is held at the first thermal treatment temperature, a first cooling rate in the first cooling, a second thermal treatment temperature, a second thermal treatment time that is a time during which the TiAl alloy is held at the second thermal treatment temperature, and a second cooling rate in the second cooling.

In the TiAl alloys of Reference Examples 1 and 2 and Examples 1 to 3, the first thermal treatment temperature was set to 1250° C., the first thermal treatment time was set to 3 hours, the second thermal treatment temperature was set to 1000° C., the second thermal treatment time was set to 3 hours, and the second cooling rate was set to a rapid cooling rate, but the first cooling rates are different form one another. The first cooling rate of Reference Example 1 was 100° C./hour, the first cooling rate of Reference Example 2 was 200° C./hour, the first cooling rate of Example 1 was 400° C./hour, the first cooling rate of Example 2 was 600° C./hour, and the first cooling rate of Example 3 was 1000° C./hour.

In the TiAl alloys of Examples 4 and 5, the first thermal treatment temperature was set to 1250° C., the first cooling rate was set to 400° C./hour, the second thermal treatment temperature was set to 1000° C., the second thermal treatment time was set to 3 hours, and the second cooling rate was set to a rapid cooling rate, but the first thermal treatment times were different from each other. The first thermal treatment time of Example 4 was set to 2.5 hours and the first thermal treatment time of Example 5 was set to 3.5 hours.

In the TiAl alloys of Reference Example 3 and Examples 6 and 7, the first thermal treatment temperature was set to 1250° C., the first thermal treatment time was set to 3 hours, the first cooling rate was set to 400° C./hour, the second thermal treatment temperature was set to 1000° C., and the second cooling rate was set to a rapid cooling rate, but the second thermal treatment times were different from one another. The second thermal treatment time of Reference Example 3 was set to 0 hour, the second thermal treatment time of Reference Example 6 was set to 2 hours, and the second thermal treatment time of Example 7 was set to 4 hours.

Next, the TiAl alloy of Comparative Example 1 will be described. The TiAl alloy of Comparative Example 1 was subjected to the thermal treatment by holding the hot-forged TiAl alloy at 1250° C. for 3 hours, and rapid cooling the hot-forged TiAl alloy from 1250° C. to a room temperature by gas fan cooling.

(Observation of Metal Structures)

The metal structures of the TiAl alloys of Reference Examples 1 and 2 and Examples 1 to 7 were observed. The metal structures were observed by using a scanning electron microscope or an optical microscope.

Figure 4A:
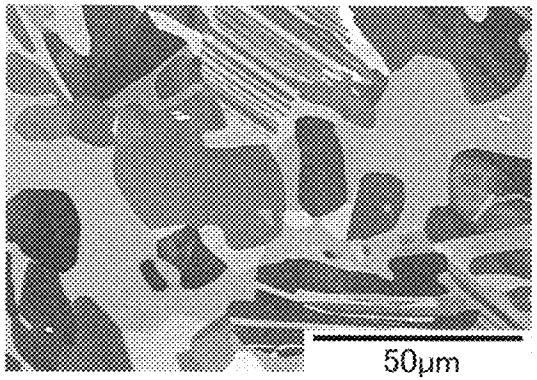
FIG. 4A is a photograph showing observation result of metal structure of TiAl alloy of Reference Example 1 in an embodiment of the present disclosure.
Figure 4B:
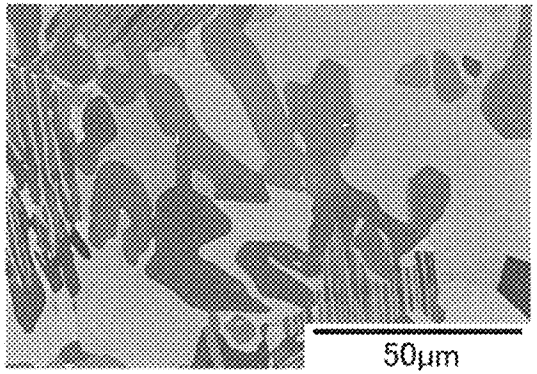
FIG. 4B is a photograph showing observation result of metal structure of TiAl alloy of Reference Example 2 in an embodiment of the present disclosure.
Figure 4C:
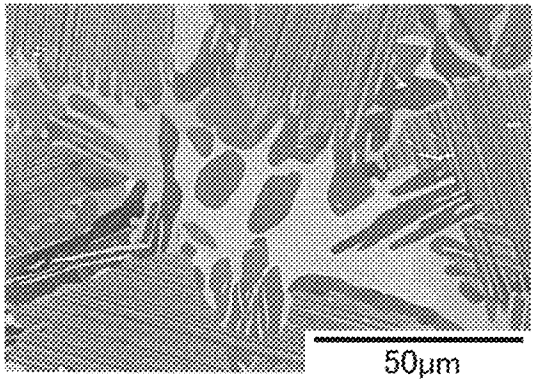
FIG. 4C is a photograph showing observation result of metal structure of TiAl alloy of Example 1 in an embodiment of the present disclosure.
Figure 4D:
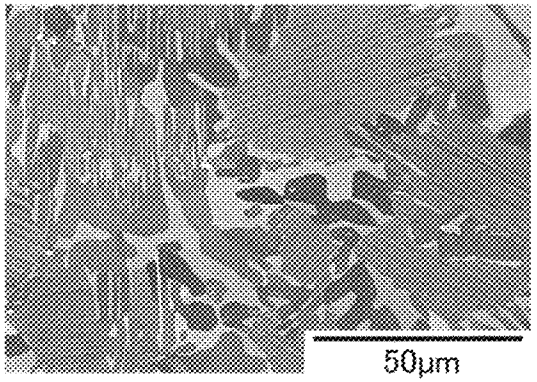
FIG. 4D is a photograph showing observation result of metal structure of TiAl alloy of Example 2 in an embodiment of the present disclosure.
Figure 4E:
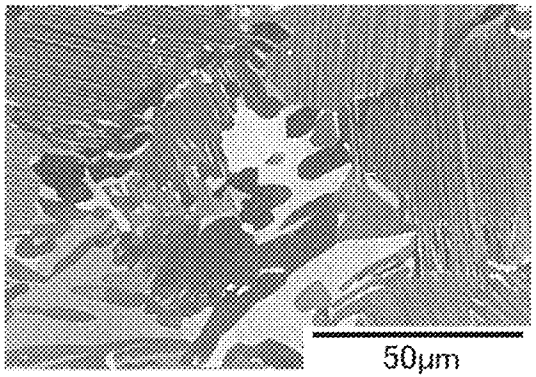
FIG. 4E is a photograph showing observation result of metal structure of TiAl alloy of Example 3 in an embodiment of the present disclosure.

FIG. 4A is a photograph showing observation result of metal structure of TiAl alloy of Reference Example 1. FIG. 4B is a photograph showing observation result of metal structure of TiAl alloy of Reference Example 2. FIG. 4C is a photograph showing observation result of metal structure of TiAl alloy of Example 1. FIG. 4D is a photograph showing observation result of metal structure of TiAl alloy of Example 2. FIG. 4E is a photograph showing observation result of metal structure of TiAl alloy of Example 3. The lamellar layer spacing of the lamellar grains of the TiAl alloys of Reference Examples 1 and 2 became wide. On the other hand, the lamellar layer spacing of the lamellar grains of the TiAl alloys of Examples 1 to 3 became narrow. From this result, it was found that the lamellar layer spacing of the lamellar grains can be narrow by setting the first cooling rate to 400° C./hour or more.

Figure 5A:
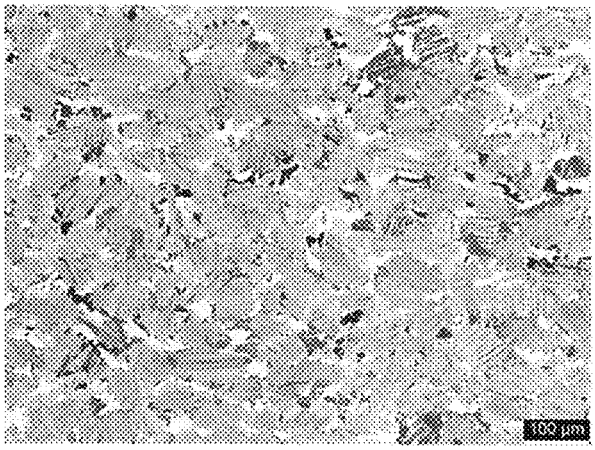
FIG. 5A is a photograph showing observation result of metal structure of TiAl alloy of Example 4 in an embodiment of the present disclosure.
Figure 5B:
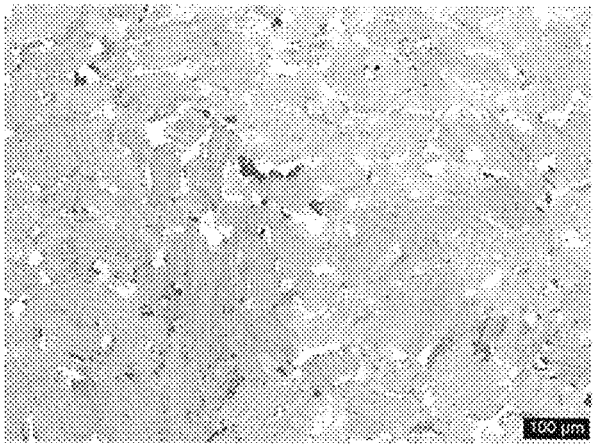
FIG. 5B is a photograph showing observation result of metal structure of TiAl alloy of Example 1 in an embodiment of the present disclosure.
Figure 5C:
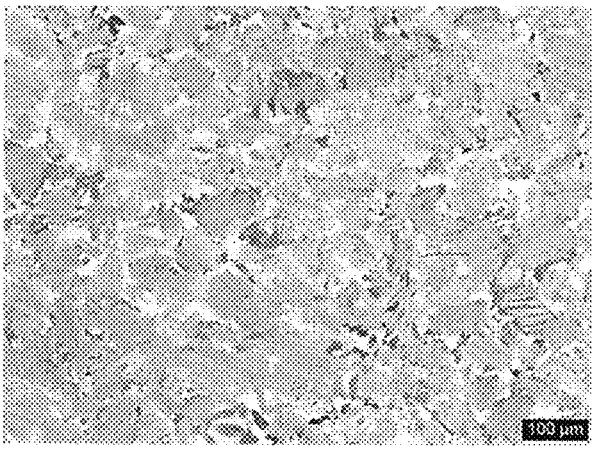
FIG. 5C is a photograph showing observation result of metal structure of TiAl alloy of Example 5 in an embodiment of the present disclosure.

FIG. 5A is a photograph showing observation result of metal structure of TiAl alloy of Example 4. FIG. 5B is a photograph showing observation result of metal structure of TiAl alloy of Example 1. FIG. 5C is a photograph showing observation result of metal structure of TiAl alloy of Example 5. The metal structures of the TiAl alloys of Examples 1, 4, and 5 were substantially the same. None of the TiAl alloys of Examples 1, 4, and 5 had unrecrystallization.

Figure 6A:
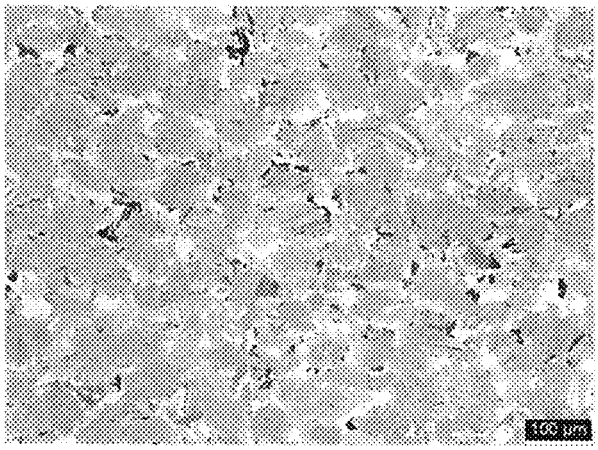
FIG. 6A is a photograph showing observation result of metal structure of TiAl alloy of Example 6 in an embodiment of the present disclosure.
Figure 6B:
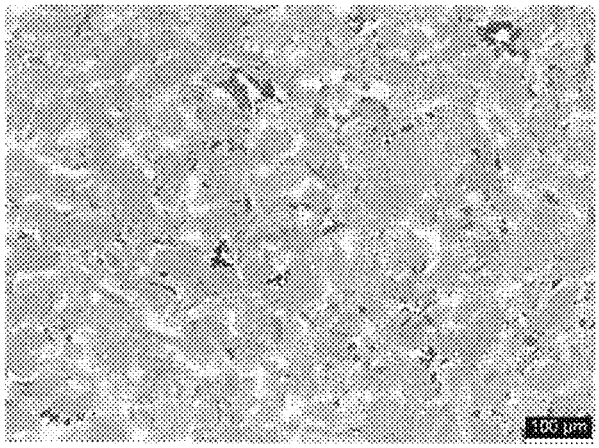
FIG. 6B is a photograph showing observation result of metal structure of TiAl alloy of Example 1 in an embodiment of the present disclosure.
Figure 6C:
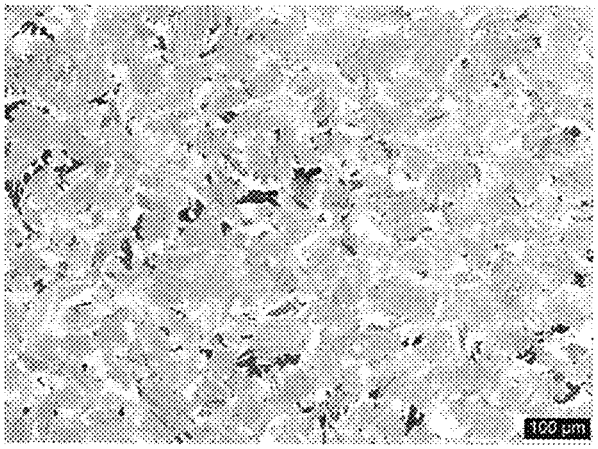
FIG. 6C is a photograph showing observation result of metal structure of TiAl alloy of Example 7 in an embodiment of the present disclosure.

FIG. 6A is a photograph showing observation result of metal structure of TiAl alloy of Example 6. FIG. 6B is a photograph showing observation result of metal structure of TiAl alloy of Example 1. FIG. 6C is a photograph showing observation result of metal structure of TiAl alloy of Example V. The metal structures of the TiAl alloys of Examples 1, 6, and 7 were substantially the same. In the TiAl alloys of all of Examples 1, 6, and 7, fine γ grains were precipitated.

(Measurement of Hardness)

The hardness of the TiAl alloys of Reference Examples 1 to 3 and Examples 1 to 7 was measured. Vickers hardness was measured at room temperature. Vickers hardness was measured in accordance with ASTM E 92.

Figure 7:
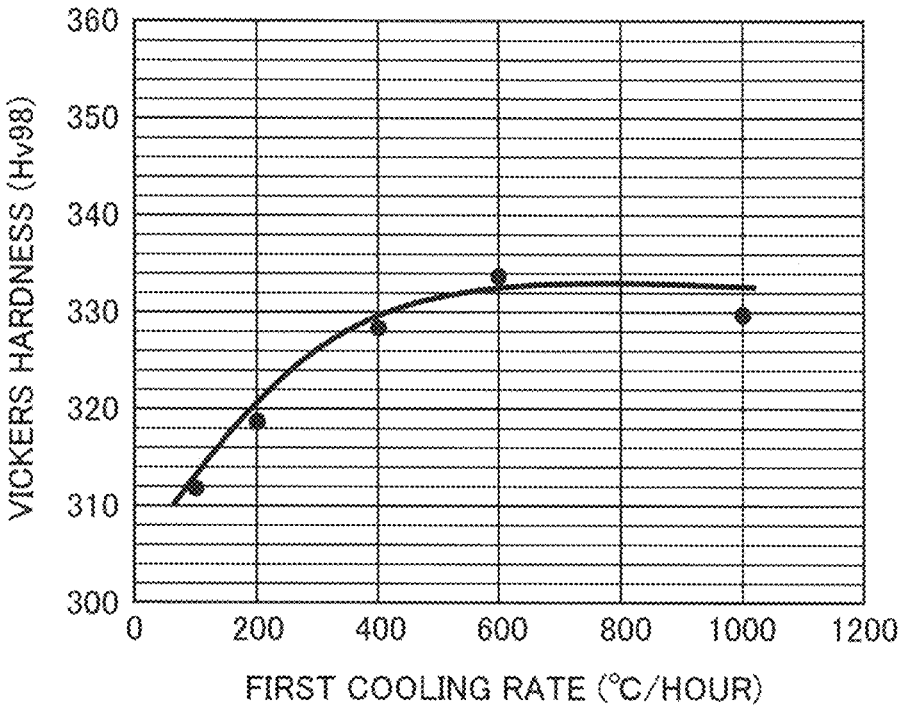
FIG. 7 is a graph showing results of measuring the hardness of TiAl alloys of Reference Examples 1 and 2 and Examples 1 to 3 in the embodiment of the present disclosure.

FIG. 7 is a graph showing results of measuring the hardness of the TiAl alloys of Reference Examples 1 and 2 and Examples 1 to 3. In the graph of FIG. 7, a horizontal axis represents a first cooling rate of each TiAl alloy, a vertical axis represents Vickers hardness, and Vickers hardness of individual TiAl alloys is indicated by black circles. Vickers hardness of Reference Examples 1 and 2 was smaller than Vickers hardness of Examples 1 to 3. From this result, it was found that the mechanical strength can be increased by setting the first cooling rate to 400° C./hour or more. Vickers hardness of Examples 2 and 3 was larger than Vickers hardness of Example 1. From this result, it was found that the mechanical strength can be more increased by setting the first cooling rate to 600° C./hour or more.

Figure 8:
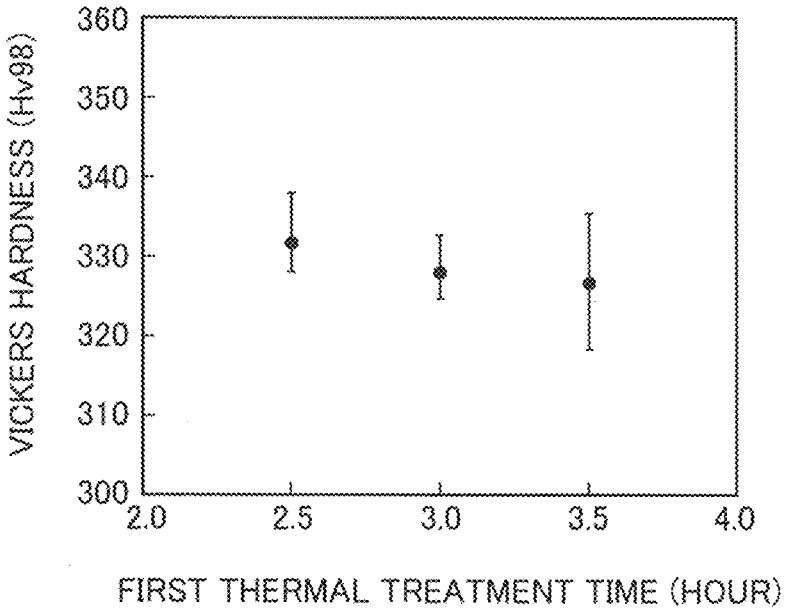
FIG. 8 is a graph showing results of measuring the hardness of TiAl alloys of Examples 1, 4, and 5 in the embodiment of the present disclosure.

FIG. 8 is a graph showing results of measuring the hardness of the TiAl alloys of Examples 1, 4, and 5. In the graph of FIG. 8, a horizontal axis represents a first thermal treatment time of each TiAl alloy, a vertical axis represents Vickers hardness, and Vickers hardness of individual TiAl alloys was indicated by black circles. Vickers hardness of Examples 1, 4, and 5 was substantially the same.

Figure 9:
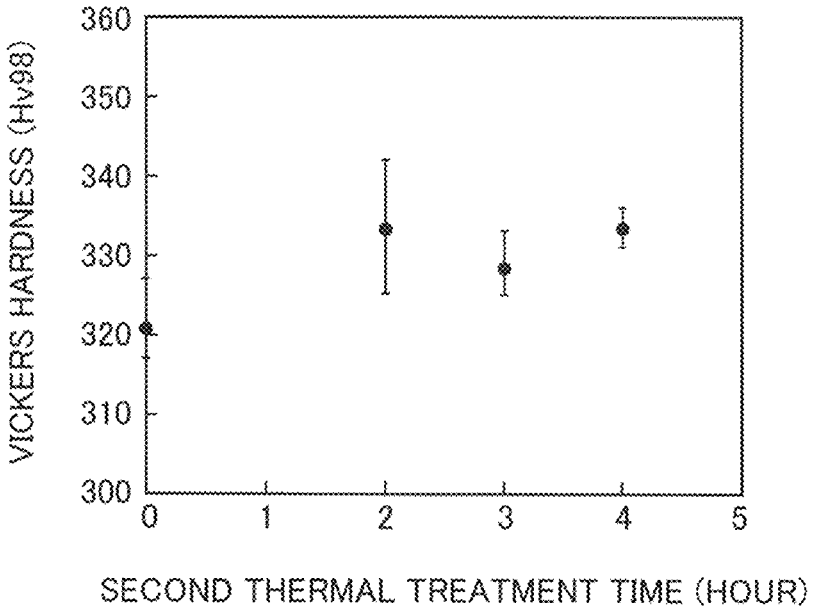
FIG. 9 is a graph showing results of measuring the hardness of TiAl alloys of Reference Example 3, and Examples 1, 6, and 7 in an embodiment of the present disclosure.

FIG. 9 is a graph showing results of measuring the hardness of the TiAl alloys of Reference Example 3, and Examples 1, 6, and 7. In the graph of FIG. 9, a horizontal axis represents a second thermal treatment time of each TiAl alloy, a vertical axis represents Vickers hardness, and Vickers hardness of individual TiAl alloys is indicated by black circles. Vickers hardness of Examples 1, 6, and 7 was larger than Vickers hardness of Reference Example 3. Vickers hardness of Examples 1, 6, and 7 was substantially the same.

Figure 10:
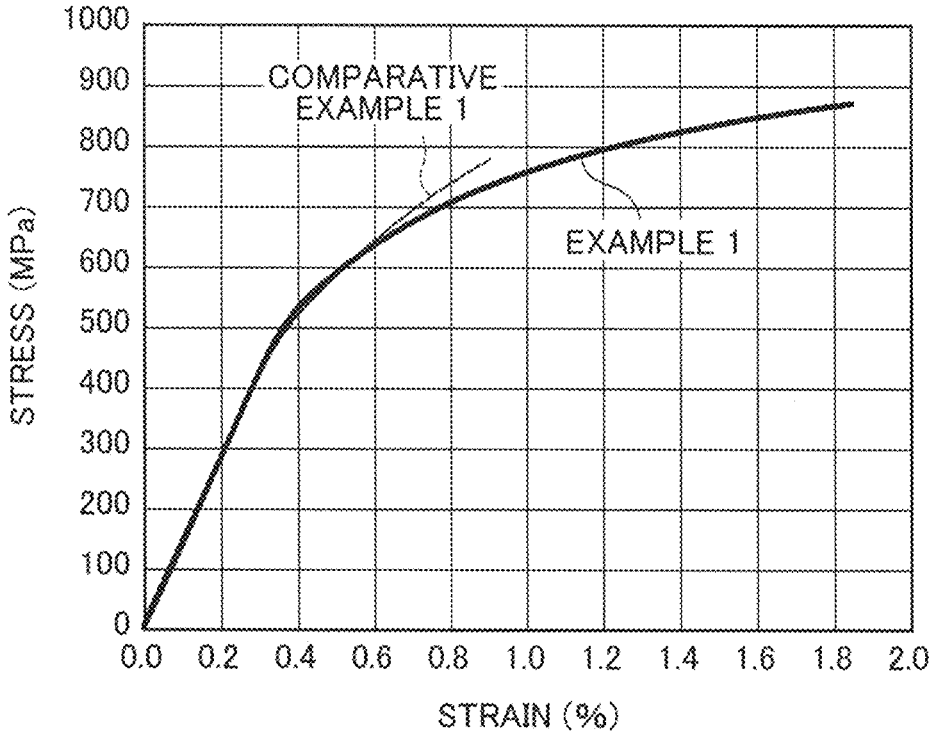
FIG. 10 is a graph showing results of tensile tests in an embodiment of the present disclosure.

The room temperature mechanical characteristics of TiAl alloys were evaluated. Tensile tests were performed at room temperature for the TiAl alloys of Example 1 and Comparative Example 1. The tensile tests were performed in accordance with ASTM E8. FIG. 10 is a graph showing results of the tensile tests. In the graph of FIG. 10, a horizontal axis represents strain, a vertical axis represents stress, and stress-strain curves of individual TiAl alloys are indicated. Example 1 is shown by a solid line, and Comparative Example 1 is shown by a broken line. The TiAl alloy of Example 1 had larger room temperature strength and room temperature ductility than the TiAl alloy of Comparative Example 1. More specifically, the room temperature ultimate tensile strength of the TiAl alloy of Example 1 was 800 MPa or more, and the room temperature tensile fracture strain of the TiAl alloy of Example 1 was 1.8% or more.

Figure 11:
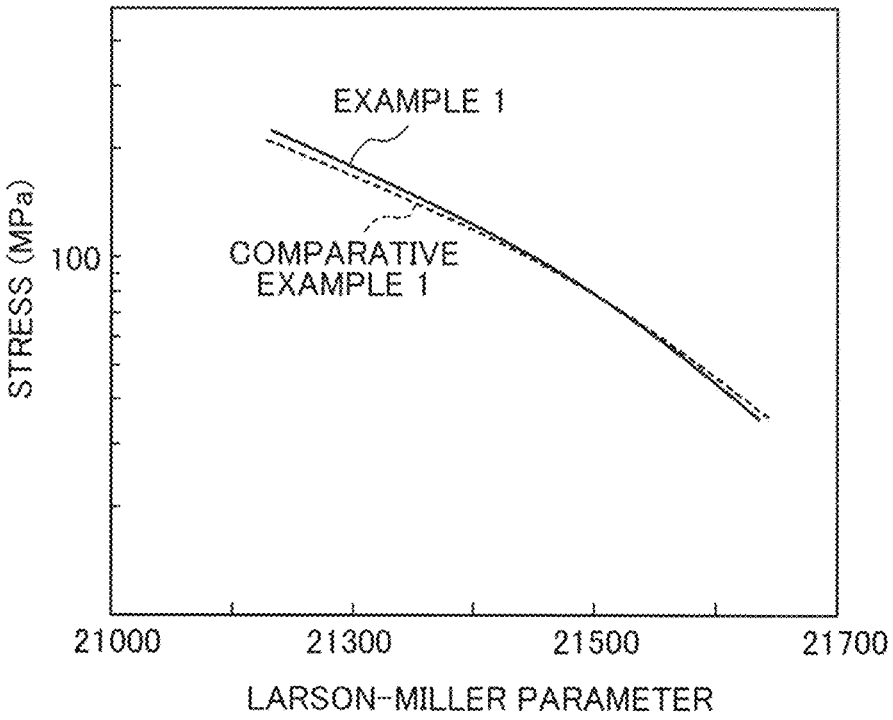
FIG. 11 is a graph showing results of creep tests in an embodiment of the present disclosure.

The high temperature mechanical characteristics of TiAl alloys were evaluated. Creep tests were performed at high temperature for the TiAl alloys of Example 1 and Comparative Example 1. The creep tests were performed in accordance with ASTM E139. FIG. 11 is a graph showing results of the creep tests. In the graph of FIG. 11, a horizontal axis represents a Larson-Miller parameter LMP (a material constant is about 20), a vertical axis represents stress, Example 1 is indicated by a solid line, and Comparative Example 1 is indicated by a broken line. The TiAl alloy of Example 1 had high temperature creep characteristics that are almost the same as those of the TiAl alloy of Comparative Example 1.

As shown in FIGS. 10 and 11, it was found that the TiAl alloy of Example 1 had excellent mechanical strength and ductility that were improved in a good balance. On the other hand, the TiAl alloy of Comparative Example 1 had more degraded room temperature strength and room temperature ductility than the TiAl alloy of Example 1. From this result, it was found that room temperature ductility and the like were degraded if the TiAl alloy was subjected to the thermal treatment and was rapidly cooled from 1250° C. to a room temperature, as in the TiAl alloy of Comparative Example 1.

The present disclosure can improve the mechanical strength and the ductility of a TiAl alloy in a good balance, and thus, is useful for a turbine blade and the like of an aircraft engine component.

What is claimed is:

1. A method of manufacturing a TiAl alloy, comprising:

a casting step of melting and casting a TiAl alloy raw material which consists of 43 at % of Al, 4 at % of Nb, 5 at % of V, 0.2 at % of B, and the balance being Ti and inevitable impurities, a hot forging step of hot forging the cast TiAl alloy by heating the cast TiAl alloy to 1200° C., and a thermal treatment step of applying a first thermal treatment to the hot-forged TiAl alloy by holding the hot-forged TiAl alloy at a temperature of 1250° C. for 2.5 to 3.5 hours, cooling the TiAl alloy subjected to the first thermal treatment to a temperature of 1000° C. at a cooling rate of 400° C./hour or more, applying a second thermal treatment to the TiAl alloy subjected to the first thermal treatment by holding the TiAl alloy subjected to the first thermal treatment at a temperature of 1000° C. for 2 to 4 hours, and rapidly cooling the TiAl alloy subjected to the second thermal treatment.

2. The method of manufacturing the TiAl alloy according to claim 1, wherein a cooling rate when the TiAl alloy subjected to the first thermal treatment is cooled is 600° C./hour or more in the thermal treatment step.

3. The method of manufacturing the TiAl alloy according to claim 1, comprising:

a stress relieving step of relieving stress by holding the TiAl alloy which is thermal-treated in the thermal treatment step at a temperature range between 850° C. or higher and 950° C. or lower for 0.5 to 4 hours.

* * * * *